US006487954B2

(12) United States Patent
Venier et al.

(10) Patent No.: US 6,487,954 B2
(45) Date of Patent: Dec. 3, 2002

(54) PISTON DECELERATION SYSTEM

(75) Inventors: Nicholas O. Venier, Tiverton, RI (US); Nicholas Bitsakis, Seekonk, MA (US)

(73) Assignee: The United States of America as represented by The Secretary of the Navy, Washington, DC (US)

( * ) Notice: Subject to any disclaimer, the term of this patent is extended or adjusted under 35 U.S.C. 154(b) by 69 days.

(21) Appl. No.: 09/805,752

(22) Filed: Mar. 14, 2001

(65) Prior Publication Data

US 2002/0129698 A1 Sep. 19, 2002

(51) Int. Cl.[7] ..... F15B 15/22
(52) U.S. Cl. ..... 91/395; 92/85 B
(58) Field of Search ..... 91/395, 396, 408, 91/409; 92/85 B

(56) References Cited

U.S. PATENT DOCUMENTS 2,649,842 A * 8/1953 Caldwell et al. ..... 91/167 R
2,667,035 A * 1/1954 Marsden ..... 91/396
3,402,592 A * 9/1968 Machon et al. ..... 92/85 B
3,583,515 A * 6/1971 Schwenk ..... 92/75
4,294,163 A * 10/1981 Boehringer ..... 92/143
4,481,868 A * 11/1984 Stump ..... 92/9
5,203,250 A * 4/1993 Sundberg ..... 91/51

* cited by examiner

*Primary Examiner*—Edward K. Look
*Assistant Examiner*—Igor Kershteyn
(74) *Attorney, Agent, or Firm*—Michael J. McGowan; Michael F. Oglo; James M. Kasischke

(57) ABSTRACT

A piston deceleration system includes an elongated piston shaft having an intermediate stop member and a second stop member formed thereon. A piston member is slidably seated on the elongated shaft between the intermediate stop member and the second stop member. A tank member is provided having a first end surface with a first opening and a shaft aperture formed therein and a second end surface having a second opening formed therein. The piston shaft is slidably positioned into the tank member through at least the first end surface shaft aperture. A shaft shock absorbing member is positioned between the intermediate stop member and the piston member on the piston shaft, and a piston shock absorbing member is positioned between the piston member and the second end of the tank member.

11 Claims, 4 Drawing Sheets

PISTON DECELERATION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a device for enabling a quiet ejection of launched items from a launch tube. More particularly, the invention relates to piston deceleration system utilizing an arrangement and shape of bumpers and a modified piston shaft.

(2) Description of the Prior Art

The current art for submarine launch systems for three inch devices was developed in the early 1960's. The launch systems utilize a basic design as shown and described in connection with FIGS. 1A–1C, hereinbelow. Because these systems create a cavitation or water hammer during launch, they are incapable of conducting a quiet launch.

Thus, a problem exists in the art whereby it is necessary to remove the cavitation or water hammer effect in order to produce a quiet launch.

The following patents, for example, disclose various types of piston control, but do not disclose an arrangement and shape of pistons or shaft as does the present invention which permits a quiet launch.

U.S. Pat. No. 4,561,248 to Quin et al.;

U.S. Pat. No. 4,609,135 to Elliesen;

U.S. Pat. No. 5,224,413 to Herner; and

U.S. Pat. No. 5,850,776 to Takeuchi et al.

Specifically, Quin et al. disclose a hydraulic shock-absorbing jack particularly for use underwater which includes a cylinder in which a piston associated with an actuated rod is slidable. The piston defines within the cylinder a first actuating chamber provided with a first inlet for actuating liquid and connected to an accumulator of elastically variable volume, and a second actuating chamber provided with a second inlet for actuating liquid. The rod is mounted to be slidable relative to the piston such that, in the event of a shock applied to the rod which would otherwise cause an increase in the volume of the second chamber, the rod alone moves relative to the piston without affecting the volume of the second chamber. The rod is provided with an enlarged head located in the first chamber and preventing its disengagement from the piston.

The patent to Elliesen discloses a sound-dampened driving apparatus for fasteners wherein a main valve means is arranged above a working cylinder of the apparatus and movable within a cylindrical bore. When the main valve means is in its lower at rest position, the main valve means separates the working cylinder from a source of compressed air and connects the cylinder to the atmosphere. When the main valve means is in its upper actuating position, the working cylinder is connected to the source of compressed air and the valve means blocks the cylinder connection to the atmosphere. The space above the main valve member within the cylindrical bore is capable of being alternately connected to either the atmosphere or compressed air, and includes a sound dampening means arranged in the space above the main valve member.

Herner discloses an impact dampening ring having a primary bumper and a secondary bumper for dampening the engagement of a piston against and end of a power cylinder. The primary bumper has a curved or arcuate surface for initial engagement with the end of the cylinder and the secondary bumper has a flat surface for secondary engagement with the end of the cylinder. The engagement of the primary and secondary bumpers dampens the impact and prevents the piston from directly engaging the end of the power cylinder. A mounting flange on the impact dampening rings provides a means for mounting the impact dampening ring onto a mounting surface of the piston. A seal along the outer perimeter of the impact dampening ring provides a fluid tight seal for the piston inside of the power cylinder.

Takeuchi et al. disclose a fluid pressure cylinder including a cylinder body, a piston accommodated in the cylinder body to define first and second pressure chambers therein, means for supplying fluid to each chamber to reciprocate the piston between a first stroke end and a second stroke end, first and second bumper surfaces, an annular cushion retainer connected to the first bumper surface, and an elastomeric cushion for deforming and cushioning an impact produced when the piston reaches the first stroke end. The bumper surfaces approach each other when the piston reaches the first stroke end and separate from one another when the piston moves toward the second stroke end. The cushion has a shape corresponding generally to a hollow conical section. The cushion includes a base section retained by the cushion retainer and a buffer section joined to the base section. The buffer section has an outer surface for contacting the second bumper surface and an inner surface that faces the first bumper surface. The outer surface forms a circular seal with the second bumper surface when the piston approaches the first stroke end. The cushion is flexed such that the buffer section moves toward the first bumper surfaces. The buffer section moves away from the first bumper surface when the piston moves towards the second stroke end.

It should be understood that the present invention would in fact enhance the functionality of the above patents by providing both a unique arrangement and shape of shock absorbing members within a launcher impulse tank assembly and structuring the piston assembly itself to aid in the shock absorption of the piston stroke.

SUMMARY OF THE INVENTION

Therefore it is an object of this invention to provide a piston deceleration system for absorbing a piston shock at one end of the stroke.

Another object of this invention is to provide a piston deceleration system utilizing a unique arrangement of deflection bumpers for reducing shock within an impulse tank assembly.

Still another object of this invention is to provide a piston deceleration system utilizing a unique shape of deflection bumpers that prevents cavitation within an impulse tank assembly.

A still further object of the invention is to provide a piston deceleration system which is integrated into existing piston systems without substantial modification.

Yet another object of this invention is to provide a piston deceleration system which is simple to manufacture and easy to use.

In accordance with one aspect of this invention, there is provided a piston deceleration system including an elongated piston shaft, a piston member slidably seated on the elongated piston shaft, a tank member having a first opening formed in a first end surface thereof and a second opening formed in a second end surface thereof, the elongated piston shaft being reciprocally inserted into the tank member through the first end surface. An intermediate stop limit member is formed on the elongated piston shaft between the piston member and the first end of the tank member. A shaft shock absorbing member is positioned between the stop limit member and the piston on the elongated piston shaft, and a piston shock absorbing members is positioned between the piston member and the second end of the tank member on the elongated piston shaft. Each of the plurality of shock absorbing members absorbing a shock of the reciprocating piston member.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

In general, the present invention is directed to an apparatus for providing a quiet ejection of devices from a submarine.

Figure 1A:
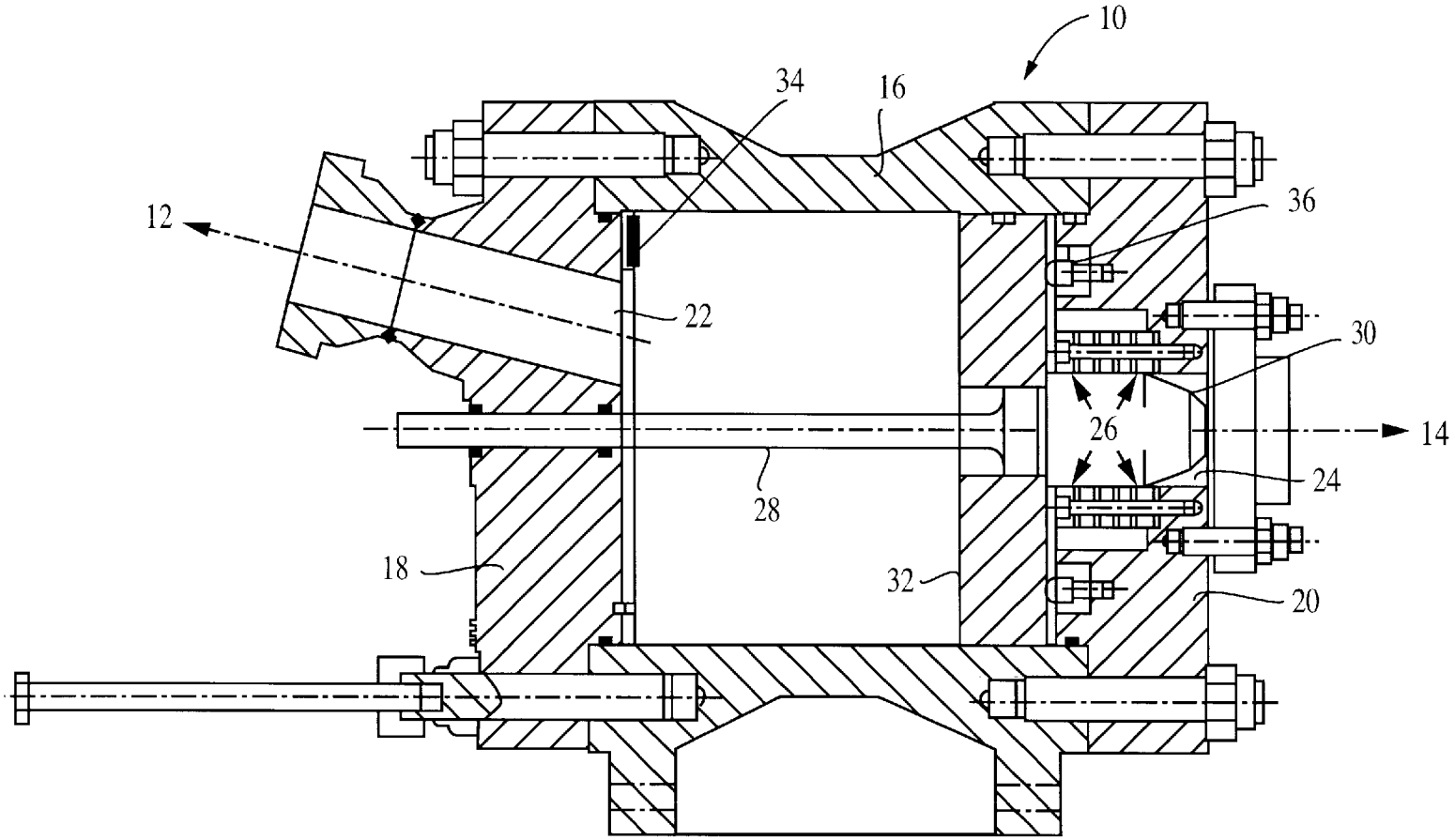
FIG. 1A PRIOR ART
FIG. 1A is a side sectional view of a prior art launcher impulse tank assembly.

In FIG. 1A there is shown a submarine small device launch systems utilizing a basic design concept which was developed in the early sixties. In operation, an impulse tank assembly 10 is connected to a high pressure air source 12 on one side, and to a 3 inch launch tube on the other side. The assembly 10 more specifically includes an impulse tank portion 16 having an air side end cap 18 and a water side end cap 20. The air side end cap 18 includes an inlet/outlet portion 22 through which a high pressure air source is received and spent air is exhausted. The water side end cap 20 includes an outlet 24 through which water is forced to the launch tube 14. Within the outlet 24 there is formed a known assembly of deceleration disks 26. A piston shaft 28 is slidably inserted through a shaft aperture in the air side end cap 18 and terminates in a conical end portion 30 interior of the deceleration disks 26. A piston member 32 is mounted on the piston shaft 28 behind the conical end portion 30 of the shaft. The piston member 32 pushes against the water side end cap 20.

In the conventional impulse tank assembly 10 of FIG. 1A, there is an arrangement of bumpers 34, 36 for assisting in the deceleration of fluid through the water side end cap 20 on the way to the launch tube 14. While the general shape of the bumpers is rectangular in cross-section, upon closer inspection of FIGS. 1B and 1C, it is shown that some of the bumpers are a plug shape with and end flange at 34 and some of the bumpers have a peaked cap shape as in bumpers 36. The bumpers 34 are mounted on the inner surface of the air side end cap 18 and the bumpers 36 are mounted on the inner surface of the water side end cap 20.

When it is desired to fire a device from the launch tube 14, high pressure air from source 12 is ported to the tank 16. This forces the piston 30 within the tank 16 to push water, which is on the side of the piston adjacent to the launch tube 14, to the breech end of a launch tube 14. As this air pressure is higher than sea pressure, a pressure imbalance is created between the muzzle end of the launch tube and breech end of a device to be launched (not shown) in the launch tube. This results in the device being ejected from the launch tube. As a submarine goes deeper under water, the sea pressure on the muzzle of the launcher becomes greater. Therefore, the high pressure air source must utilize higher and higher pressure to satisfactorily effect a launch.

In operation, as the piston member 32 reaches an end of its stroke, there would be a metal to metal impact if provisions where not incorporated into the system design to prevent such an occurrence. Such contact would not only result in shock to the system's hardware but also result in a high level of air-born and water-born noise from the submarine. In order to reduce the effect of the end of stroke impact, the rubber bumpers 34, 36 are incorporated into both end caps 18 and 20 of the impulse tank 16 and the water side of the impulse tank incorporates the deceleration disks 26 therein. Bumpers 34 and 36 are solid, rubber rings which are bolted to end caps 18 and 20.

Figure 1B:
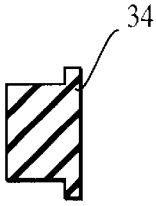
FIG. 1B PRIOR ART
FIG. 1B is a side sectional view of a prior art bumper for the impulse tank assembly of FIG. 1A.
Figure 1C:
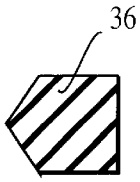
FIG. 1C PRIOR ART
FIG. 1C is a side sectional view of another prior art bumper for the impulse tank assembly of FIG. 1A.

Referring now more particularly to FIGS. 1B and 1C, it can be seen that the known bumpers are represented by pieces of rubber shown in cross section. When the piston 32 contacts these bumpers, they prevent metal to metal contact but do very little to slowly mitigate the energy which is pushing the piston 32 into the bumper 34, 36. This is because rubber is non-compressible and their design is such that little deflection takes place. The deceleration disks 26 work in conjunction with the conical end 30 of the piston shaft 28 to restrict fluid flow from moving from the water side of the piston member 32 to the launch tube at the end of its power stroke.

As the shaft/piston assembly 28, 32 move toward end of their stroke, more and more deceleration disks 26 are effectively scaled against fluid flow by the cylindrical section of the shaft cone 30. This results in higher and higher pressure being built up on the water side of the piston member 32. This pressure counteracts the high air pressure on the air side of the piston member 32, in an attempt to cushion the last portion of the piston's travel. However, in spite of the piston deceleration control effected by the bumpers 34, 36 and the deceleration disk dashpot 26, the column of water in the pipe leading to the launch tube tends to continue to flow in the direction of the launch tube. This momentum results in a low pressure area being created in the area of the launch pipe, closest to the impulse tank 16. This low pressure results in a rapid stop of all flow in the pipeline which creates cavitation or water hammer. The water hammer is detrimental to the system with respect to its transmitted shock and vibration loads transmitted to mechanical parts and detrimental to the ship in that it provides and externally detectable acoustic event.

When the system known in the art (FIGS. 1A, 1B, 1C) was first developed, this water hammer was inconsequential as the 3 inch launcher was primarily utilized for distress buoys, marker buoys, broad band jammers and other devices which themselves revealed ship position. However, the 3 inch launcher is now used for a myriad of devices which include bathyothermographs, time delay jammers, decoy devices and other devices where a quiet launch is desirable.

Accordingly, the inventors have discovered a modification to the existing system which is incorporated into the system with a minimal expenditure of funds and a minimal impact on existing ship hardware so that ship arrangement problems will not be introduced.

Figure 2:
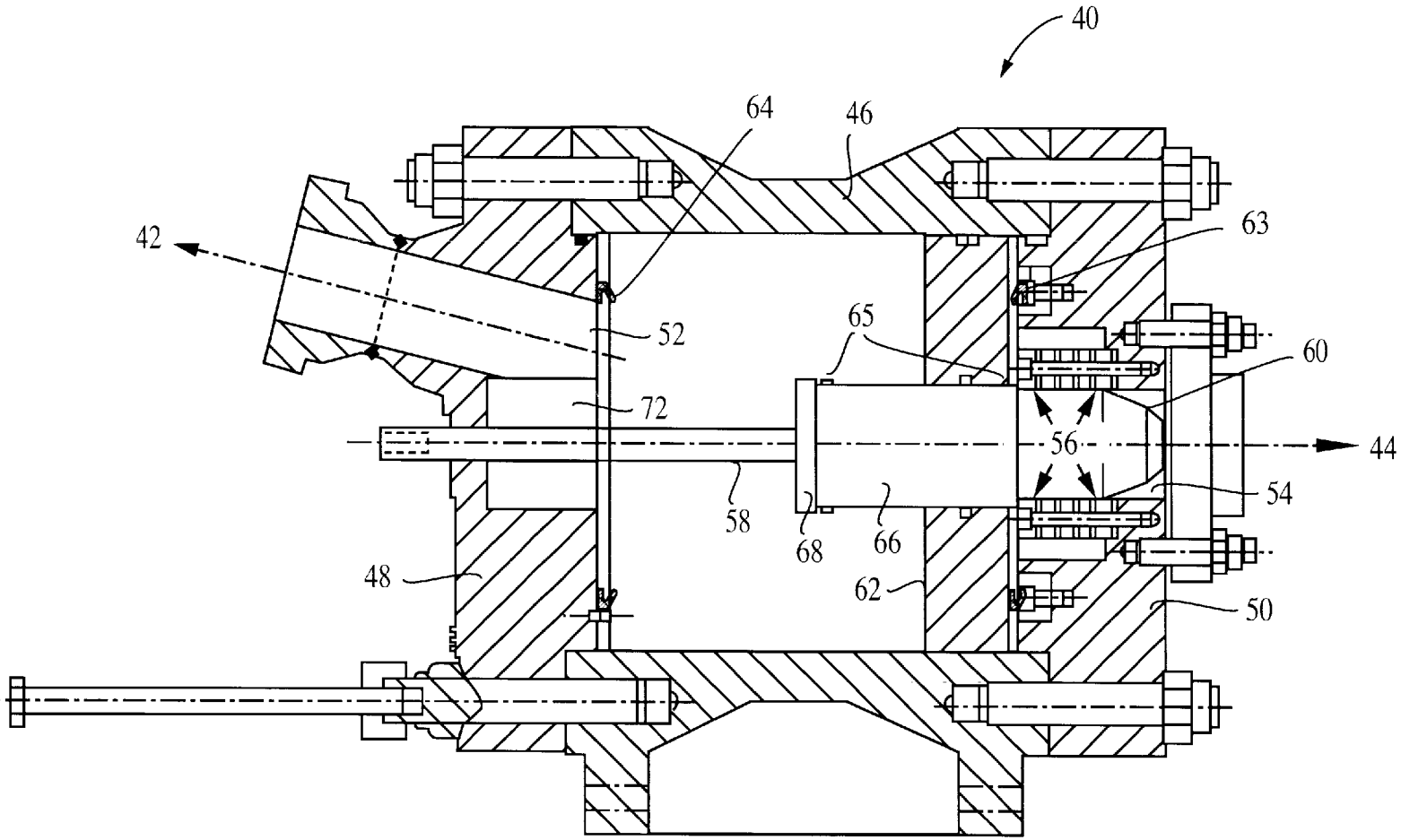
FIG. 2 is a side sectional view of the launcher impulse tank assembly according to a preferred embodiment of the present invention having deflection bumpers therein.

FIG. 2 reflect both improved bumpers and improved connection between the piston and piston shaft according to a first preferred embodiment of the present invention.

Figure 4A:
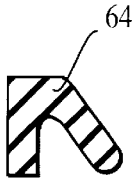
FIG. 4A is a side sectional view of a deflection bumper according to the present invention.
Figure 4B:
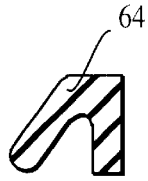
FIG. 4B is a reverse sectional view of a deflection bumper according to the present invention.

In detail, the device shown in FIG. 2 includes an impulse tank assembly 40 connected to a controllable high pressure air source 42 on one side, and to a 3 inch launch tube 44 on the other side. The launcher assembly 40 more specifically includes an impulse tank portion 46 having an air side end cap 48 and a water side end cap 50. The air side end cap 48 includes an inlet/outlet portion 52 through which a high pressure air source is received and spent air is exhausted. The water side end cap 50 includes an outlet 54 through which water is forced to the launch tube 44. Within the outlet 54 there is formed a known assembly of deceleration disks 56. A piston shaft 58 is slidably inserted through a shaft aperture in the air side end cap 48 and terminates in a conical end portion 60 interior of the deceleration disks 56. A piston member 62 is slidably mounted on an enlarged portion 66 of the piston shaft 58 behind the conical end portion 60 of the shaft. At this point the substance of the present invention differs from the conventional art described in connection with FIGS. 1A, 1B, and 1C in the following respects. A water side deflection bumper 63 is mounted on the inner surface of the water side end cap 50. An air side deflection bumper 64 is mounted on the inner surface of the air side end cap 48 and the inner surface of the water side end cap 50. Deflection bumpers 63, 64 are ring shaped, rubber bumpers fastened to the inner surfaces of end caps 48 and 50 by bolts; however, another mounting method such as an adhesive could be used. The deflection bumpers 63 and 64 of the present invention (FIGS. 4A and 4B) are configured such that they need not be compressed but rather deflect. The amount of desired deflection can be adjusted and modified to meet the particular needs of a launch application, however, its configuration is such that it requires a timed absorption of energy to cause the deflection. As a result of this time factor, the sharp impact associated with the attempt to compress a non-compressible material is mitigated.

Figure 3:
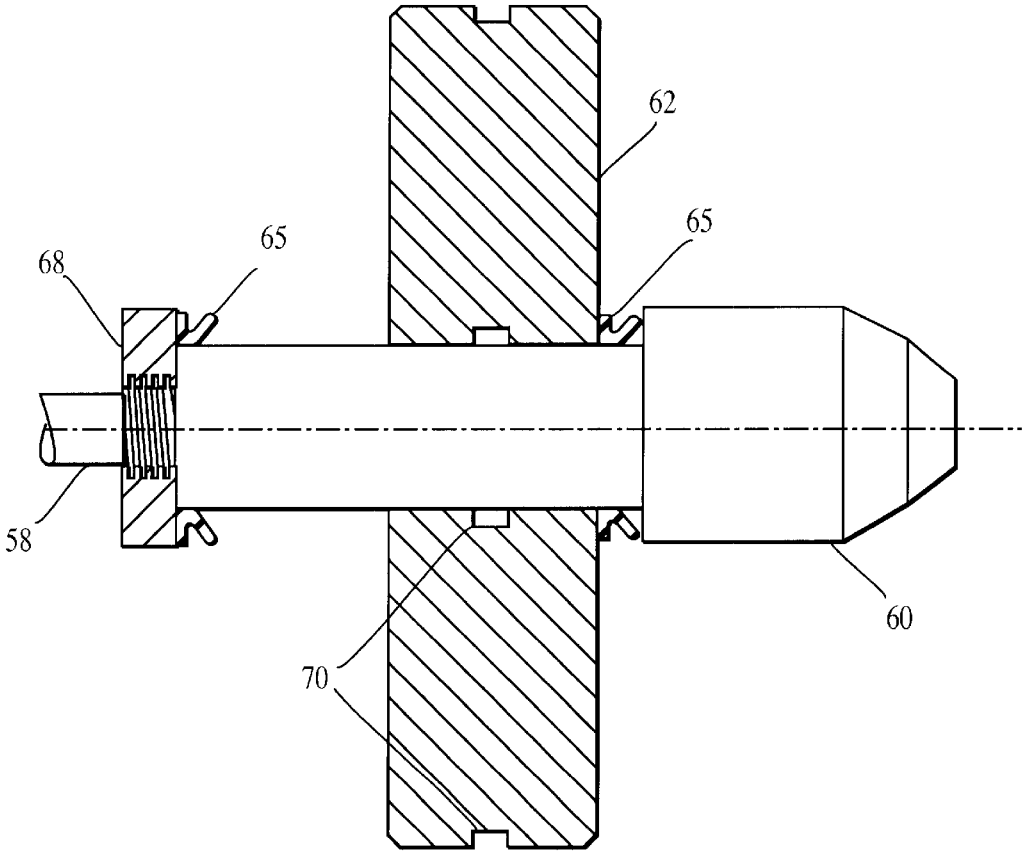
FIG. 3 is a sectional view of deflection bumpers mounted on a movable shaft/piston assembly according to a preferred embodiment of the present invention.

The piston and shaft assembly is likewise different than that previously known in the art. In particular, the device of FIG. 1A reflects a piston 32/shaft 28 assembly where there is no relative motion between these two parts. FIG. 3 reflects the detail of a piston 62/shaft 58 assembly found in FIG. 2 where the piston 62 can actually slide on a portion of the shaft 58. The shaft portion 58 includes enlarged portion 66 having a greater diameter than the diameter of the shaft 58. Portion 66 is joined proximate the conical end portion 60 of the shaft 58. A stop member 68 is provided at an end of portion 66 distal from the conical end portion 60. The stop member 68 is of a larger outer diameter than the outer diameter of portion 66, as shown. Although the connection of stop member 68 to portion 66 is shown as threaded, this connection may be made by any suitable means in the art so as to maintain the enlarged portion 66 and piston 62 securely on the piston shaft 58. The manner of attaching portion 66 to the piston shaft 58 is by any means which will secure the two together. Alternatively, the shaft 58 may be formed as a single extruded piece having separate portions including the conical end 60, enlarged portion 66, and the shaft 58 of desired diameters as shown. Neither means of formation is preferred and either may be used according to a manufacturer's selection.

Seal grooves 70 are formed in the inner and outer peripheral surface of the piston member 62 so as to enable sliding of the piston member 62 along the housing 66 as well as within the impulse tank portion 46 of the impulse tank assembly 40.

Deflection bumpers 65 are positioned on enlarged portion 66 against an inner end of the enlarged diameter of the stop member 68 and the inner flat side of the conical end 60. In FIG. 2, the bumper 63 between the piston 62 and the conical end 60 is compressed to show the deflection capability of the deflection bumper 63 when acted upon by a force of the piston member 62. Likewise, as the piston member 62 slides to the opposite end of the housing 66, the piston-member 62 will compress the deflection bumper 64 thereat in a similar manner.

Once again, when it is desired to fire a device from the launch tube 44, high pressure air is ported to the tank 46. This forces the piston 62 within the tank 46 to push water, which is on the side of the piston adjacent to the launch tube 44, to the breech end of launch tube 44. As this pressure is higher than sea pressure, a pressure imbalance is created between the muzzle end and breech end of a device to be launched (not shown) in the launch tube. This results in the device being ejected from the launch tube. As a submarine goes deeper under water, the sea pressure on the muzzle of the launcher becomes greater. Therefore, the high pressure air source must utilize higher and higher pressure to satisfactorily effect a launch.

The deceleration disks 56 work in conjunction with the conical end 60 of the piston shaft 58 to restrict fluid flow from moving from the water side of the piston member 62 to the launch tube at the end of its power stroke. As the shaft/piston assembly 58, 62 move toward the end of their stroke, more and more disks are effectively scaled against fluid flow by the cylindrical section of the shaft cone 60. This results in higher and higher pressure being built up on the water side of the piston member 62. This pressure counteracts the high air pressure on the air side of the piston member 62, in an attempt to cushion the last portion of the piston's travel.

Therefore, when the piston assembly comes to its normal end of stroke, the shaft 58 will continue to travel into the region where water hammer would normally occur. This will provide additional time for the deceleration of the water column which has been forced through the pipe by movement of the piston 62. This effectively closes the source of the water supply in a more gradual fashion than associated by the abrupt end of stroke associated with the end of travel of the piston 62.

Referring again to FIG. 2, and in connection with the reverse travel of the piston stroke, it should also be noted that the end cap 48 on the high pressure air side of the assembly includes a cup shaped recess 72 formed therein about the shaft aperture. The retainer end 68 of the piston/shaft assembly is received within the recessed cup portion 72 that the enlarged shaft/retainer assembly does not impede full travel of the piston 62 within the basic impulse tank 46.

Figure 5:
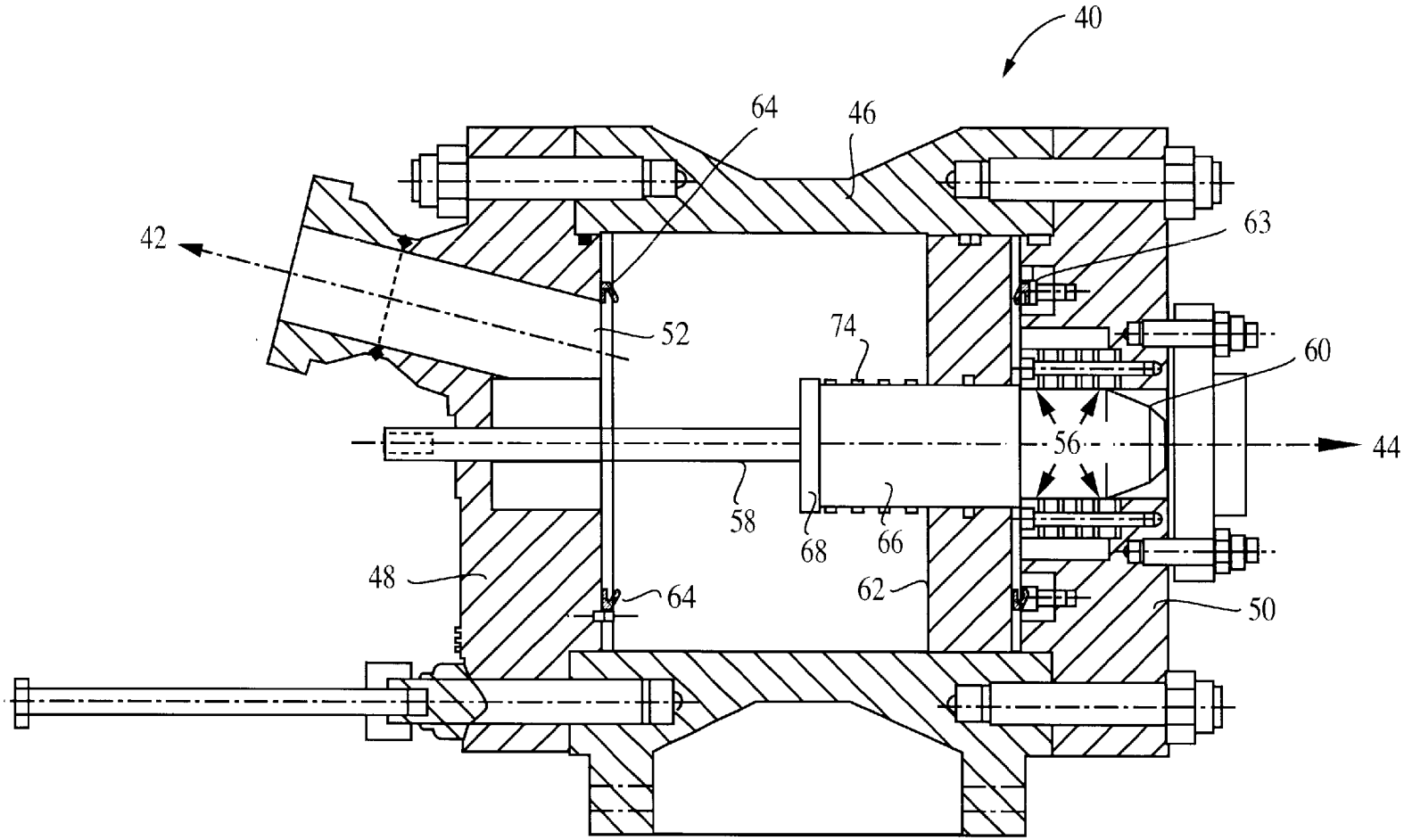
FIG. 5 is a side sectional view of a launcher impulse tank assembly according to a second preferred embodiment of the present invention.

FIG. 5 illustrates an alternative embodiment, in which like reference numbers refer to the like parts of FIG. 2. As an alternative the deflection bumpers provided in connection with the housing member 66, it is also possible to utilize a spring 74 such as a coiled spring on the housing portion 66 of the piston/shaft assembly to optimize system performance. The spring 74 is positioned between the inner surface of the retainer 68 and the air-side surface of the piston member 62. The spring operates in the same manner as the deflection bumpers 65.

Because of the inventive features of the present invention, in addition to the piston deceleration control effected by the deflection bumpers 64 and the deceleration disk dashpot 56, the column of water in the pipe leading to the launch tube tends to drastically reduce its flow in the direction of the launch tube. This lessened momentum as compared to the conventional art removes or substantially reduces the low pressure area being created in the area of the launch pipe, closest to the impulse tank 56. This correction avoids such a rapid stop of flow in the pipeline and thus eliminates the prior cavitation or water hammer. As a result, there are no detrimental or readily detectible noise from the launch of a device from the impulse tank assembly and there will no longer be a detectable acoustic signature with respect thereto.

Accordingly, the incorporation of the features described will quiet the launch system such that system shock and vibration loads and operating noises are reduced. In addition, the present invention can be easily incorporated into both new and existing ship systems at a low cost. All system modifications are internal, integrated into the impulse tank assembly and are therefore transparent to the system operator. It is further beneficial and advantageous that there is no impact on ship arrangement of components.

In view of the above detailed description, it is anticipated that the invention herein will have far reaching applications other than those of underwater vehicles. This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A piston deceleration system comprising:

an elongated piston shaft having an intermediate stop member and a second stop member formed thereon;

a piston member slidably seated on said elongated piston shaft between said intermediate stop member and said second stop member;

a tank member having a first end surface with a first opening and a shaft aperture formed therein and a second end surface having a second opening formed therein, said elongated piston shaft slidably positioned in said tank member through at least said first end surface shaft aperture;

a shaft shock absorbing member positioned between said intermediate stop member and said piston member on said piston shaft; and a piston shock absorbing member positioned between said piston member and the second end surface of said tank member.

2. The system according to claim 1 wherein said piston shaft has a first end proximate said tank member first end surface and second end proximate said tank member second end surface has been said piston shaft further comprising a shaft cone positioned on said piston shaft second end.

3. The system according to claim 1 wherein said first end surface of said tank member is a first end cap.

4. The system according to claim 1 wherein said second end surface of said tank member is a second end cap.

5. The system according to claim 1 wherein said intermediate stop member is a retaining member threadably secured to said piston shaft.

6. The system according to claim 1 wherein:

said shaft shock absorbing member is a resilient bumper ring having a "V" shaped cross-section; and said piston shock absorbing member is a resilient bumper ring having a substantially "V" shaped cross-section.

7. The system according to claim 6 wherein each said substantially "V" shaped resilient bumper includes a fixed side for securement to a surface and a free side for absorbing a load applied thereto.

8. The system according to claim 2 wherein a battery shock absorbing member is positioned on said first end of said tank member.

9. The system according to claim 2 wherein said second end second opening is formed for receiving said shaft cone, said second opening having deceleration disks positioned therein for hydrodynamically acting with said shaft cone to decelerate said piston shaft.

10. The system according to claim 1 wherein said shaft shock absorbing member is a coiled spring surrounding said piston shaft between said intermediate stop member.

11. The system according to claim 1 wherein said piston shaft has a first end proximate said tank member first end and a second end proximate said tank member second end, and said piston shaft further comprises:

a shaft cone positioned at said piston shaft second end; and an enlarged portion positioned between said piston shaft second end and said intermediate stop member, said housing having a larger diameter than said piston shaft, said piston being slidably positioned on said enlarged portion.

* * * * *